United States Patent [19]

Kupka

[11] 4,403,868

[45] Sep. 13, 1983

[54] AGITATOR WITH TWO SETS OF BLADES EACH DRIVEN IN AN OPPOSITE DIRECTION ABOUT A COMMON AXIS

[76] Inventor: Dieter Kupka, Postfach 59, Binger Landstr. 37a, 6750 Kirn, Fed. Rep. of Germany

[21] Appl. No.: 283,126

[22] Filed: Jul. 14, 1981

[30] Foreign Application Priority Data

Jul. 21, 1980 [DE] Fed. Rep. of Germany ..... 3027567

[51] Int. Cl.[3] ..... B01F 7/18

[52] U.S. Cl. ..... 366/295; 277/59; 277/65; 277/DIG. 8; 366/296

[58] Field of Search ..... 366/293, 294, 295, 296, 366/325, 349; 277/59, 65, DIG. 8

[56] References Cited

U.S. PATENT DOCUMENTS

| | | | |
|---|---|---|---|
| 1,767,346 | 6/1930 | Christiansen | 366/296 |
| 2,209,287 | 7/1940 | Simpson | 366/294 X |
| 2,265,867 | 12/1941 | Sauer | 366/294 X |
| 3,743,302 | 7/1973 | Bach et al. | 277/65 X |
| 3,782,739 | 1/1974 | Kahanek et al. | 277/65 X |

*Primary Examiner*—Philip R. Coe

*Attorney, Agent, or Firm*—Toren, McGeady and Stanger

[57] ABSTRACT

An agitator for stirring a flowable material in a vessel, such as a pressure vessel, includes a first set of agitator blades laterally surrounded by a second set. Each set has its own agitator shaft, an inner shaft for the first set of blades and a tubular outer shaft for the second set. The shafts are coaxial and extend through a housing into the vessel. Each set of blades rotates in an opposite direction about a common axis. An axial seal ring unit forms a seal between the inner shaft and the outer shaft and between the outer shaft and the housing. The seal ring unit is formed of two coaxial plural component seal rings, one between the two shafts and the other between the outer shaft and the housing.

16 Claims, 14 Drawing Figures

13
20
62
9
1
10
22
24
23
25
21
26
27
29
45
46
55
28
30
31
32
63
64
A
33
34
A
A
A
38
37
44
42
41
43
40
39

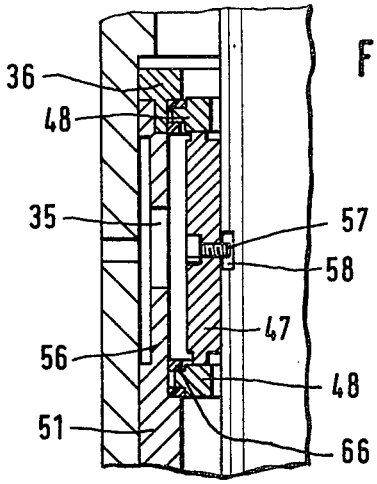
FIG.8
FIG.9
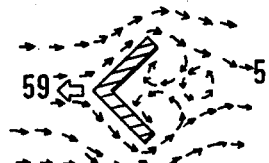
FIG.10
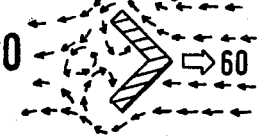
FIG.11
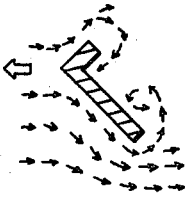
FIG.12
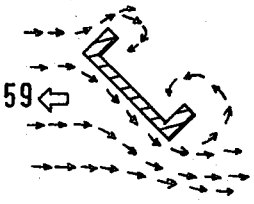
FIG.13
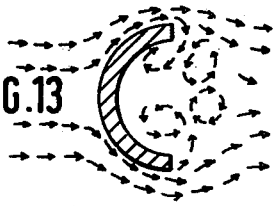
59
FIG.14
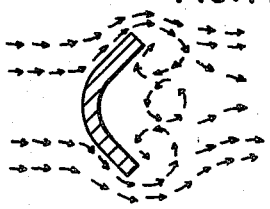

AGITATOR WITH TWO SETS OF BLADES EACH DRIVEN IN AN OPPOSITE DIRECTION ABOUT A COMMON AXIS

SUMMARY OF THE INVENTION

The present invention is directed to an agitator for stirring flowable materials. Such an agitator can be secured tightly to a vessel, such as a pressure vessel, and includes two agitating elements each driven for rotation in opposite directions about a common axis. The outer agitating element encloses the inner agitating element and is mounted on a tubular outer agitating shaft laterally enclosing the inner agitating shaft. Each agitating element has agitating blades which can be arranged to generate different flows in the material to be stirred, depending on the desired application. The agitating shafts extend through a housing in which the inner shaft is sealed relative to the tubuler shaft and the tubular shaft is sealed relative to the housing.

In agitators of this general type, such as disclosed in the brochure P-6.2 of Chemienorm GmbH, 6570 Kirn, up until the present time only stuffing box packings have been used for sealing the inner shaft and the oppositely rotating outer shaft and between the outer shaft and the stationary housing. In these known arrangements, two agitator gears were used, one for the inner and the other for the outer agitating shaft. These two gears were arranged one above the other with the upper gear housing supported by a first cage on the lower gear housing and the lower gear housing supported on a second cage mounted on the vessel. The housing of an upper packing gland used for sealing the inner agitating shaft relative to the outer one had to rotate along with the support bracing its packing rings, together with the outer agitating shaft. In this construction it would not have been possible to replace the rotating packing gland housing with a housing for a slide ring seal, because a slide ring seal must be equipped for the passage for cooling, sealing and lubricating media. Packing glands, however, can only be used for a vessel having an operating pressure up to a maximum of 6 bar. Agitators of this type could be used, in spite of the excellent agitating effect of the oppositely directed agitating elements, only for work without any pressure load or with a pressure load only up to a maximum of 6 bar.

Therefore, it is the primary object of the present invention to provide an agitator with two oppositely rotating agitating elements which are suitable for work in a pressure vessel at a pressure higher than has been possible in the past by using axial or slide ring seals. Further, another object of the invention is to provide an embodiment which is as universally usable as is possible.

In accordance with the present invention, an outer agitating element is arranged around an inner agitating element and is supported on a tubular shaft. The tubular shaft is sealed relative to the shaft of the inner agitating element and to the enclosing housing by a double-acting slide ring seal unit made up of two plural component slide rings seals arranged one within the other and extending coextensively within the enclosing housing. One seal ring is located between the inner shaft and the outer shaft and the other seal ring is located between the outer shaft and the stationary housing.

One feature of the invention involves the placement of the components of the slide ring seal subject to wear either directly on or inserted into the agitating shaft without the use of interconnecting protective sleeves.

In such an arrangement, as compared to conventional agitators using protective sleeves, it is possible to reduce the diameter of the components of the double acting slide ring seal unit disposed in a nested arrangement.

The components of the slide ring seals which are subject to wear require cooling, sealing and lubricating media and such media can be supplied through the inner agitating shaft. A duct can be provided within the inner agitating shaft carrying the media to the parts of the slide ring seal which are subject to wear with the duct being branched off in the region of the ring seal. A stationary feed head can be provided on the upper portion of the inner agitating shaft. The inner and outer spaces of the slide ring seal unit containing parts subject to wear are interconnected by means of ducts and a return duct is provided from the housing.

In accordance with the present invention, the double-acting slide ring seal unit is arranged so that the seal unit can be easily disassembled for replacing components subject to wear or for other repairs. Accordingly, the housing for the slide ring seal unit is positioned on the vessel containing the material to be agitated. Above the housing the inner and the outer agitating shafts can be disconnected. An intermediate support housing is positioned on the vessel and encloses the region of the slide ring seal unit and the superposed position where the agitating shafts can be disconnected. A gear block mounted within another housing is positioned on the intermediate support housing and includes output shafts for the inner and the outer agitating shafts and forms a closed unit.

Another feature of the invention involves the arrangement of the disconnecting point for the outer agitating shaft including an intermediate revolving housing. This revolving housing is made up of a flange at the lower end of an upper section of the outer agitating shaft and a flange sleeve positioned on a lower outer agitating shaft section with spacer bolts connecting the two. The disconnecting point for the adjacent sections of the inner agitating shaft is formed by a flange on an upper shaft section and a flange sleeve placed in a groove-spring connection rigidly connected for rotation on a middle section of the inner agitating shaft.

Accordingly, the slide ring seal unit including the housing, the section of the inner agitating shaft enclosed within the seal, the section of the outer agitating shaft which encloses the corresponding section of the inner shaft, and an assembly sleeve forming part of the outer shaft section are constructed as a block which can be disassembled as a whole. The removed block can be easily replaced with a new block or it can be disassembled in a special workshop where all the parts can be worked on separately, as required.

To-date, a separate gear has been used to drive each of the two oppositely rotating agitating shafts, however, slide ring seal units could not be used.

Another feature of the invention involves the combination of the gears for the oppositely rotating shafts into a single unit with two oppositely rotating output shafts in a modular housing so that it is possible to connect different driving sources. By using a gear housing with two oppositely rotating output shafts it is possible to provide a universally usable agitator system. Just as the driving sources may be of a different type depending on the application, the gears themselves may also be of a very different construction when a modular housing is used having two oppositely rotating output shafts. The gear block permits the use of spur-gear systems, tapered spur wheel gears, work-spur wheel gears, V-belt-tapered spur wheel gears, V-belt-spur gear systems and hydraulic spur gear systems. Depending on the spatial conditions involved, the drive may be introduced horizontally or vertically into the gear housing, while the two oppositely rotating output shafts usually extend vertically downward out of the gear housing.

Finally, the configuration or shape of the agitating blades depends on the application. An intensive turbulent vertical mixing of the contents of a vessel is not always necessary or desirable. For instance, solid substances with a specific weight are, at times, to be homogeneously suspended in low specific weight liquids. In all cases, however, a uniform agitating effect in all agitating zones is desired at a low energy consumption of the drive and a limited space requirement for the gear units and the entire agitating arrangement. Therefore, the versatility of the agitator is enhanced when the agitating blades of the oppositely rotating agitating elements can be easily exchanged. Agitating blades for a portion of their length, preferably the free end portion, can be in the shape of equilateral angles, unequal sided angles, U-shaped in cross-section, or curved convexly or concavely in the direction of rotation. The angle sections can be installed so that the apex of the angle faces in the direction of rotation. In a U-section the webs are directed rearwardly relative to the rotational direction. Further, the legs of the angle sections or the webs of the U-shaped section are disposed inclined with respect to the direction of rotation.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

BRIEF DESCRIPTION OF THE DRAWING

In the drawing:

FIG. 8 illustrates details of FIG. 7 on a further enlarged scale; and

FIGS. 9 to 14 are schematic illustrations of different shapes of agitating blades used with the agitator of the present invention and showing their effect on flow formation.

DETAIL DESCRIPTION OF THE INVENTION

Figure 1:
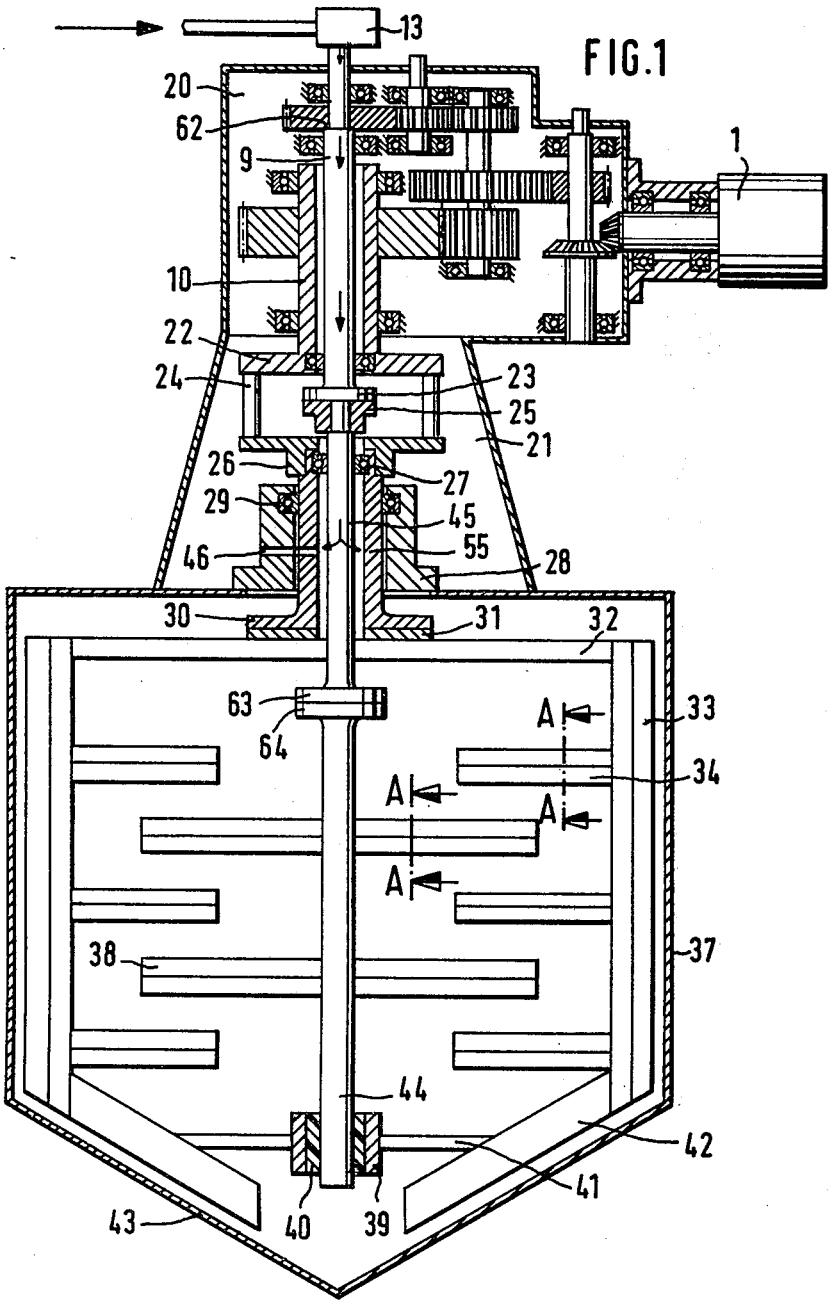
FIG. 1 is a vertical sectional view illustrating the complete agitator embodying the present invention.
Figure 2:
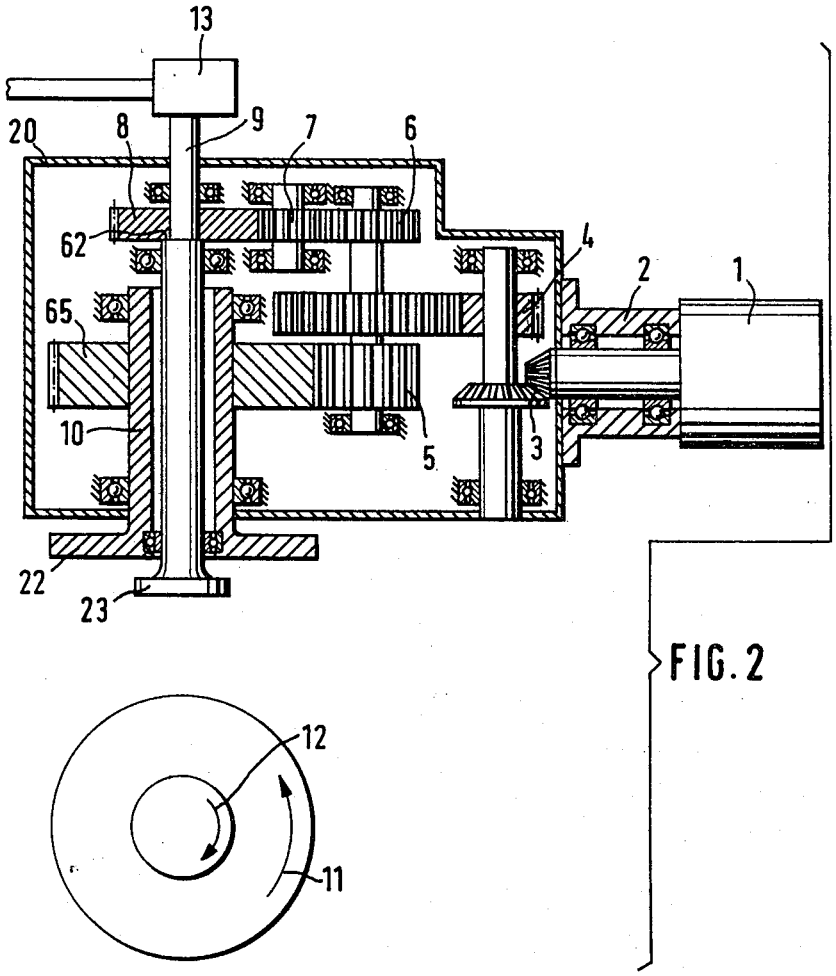
FIGS. 2 to 6 are schematic views displaying embodiments of the drive gear block.
Figure 7:
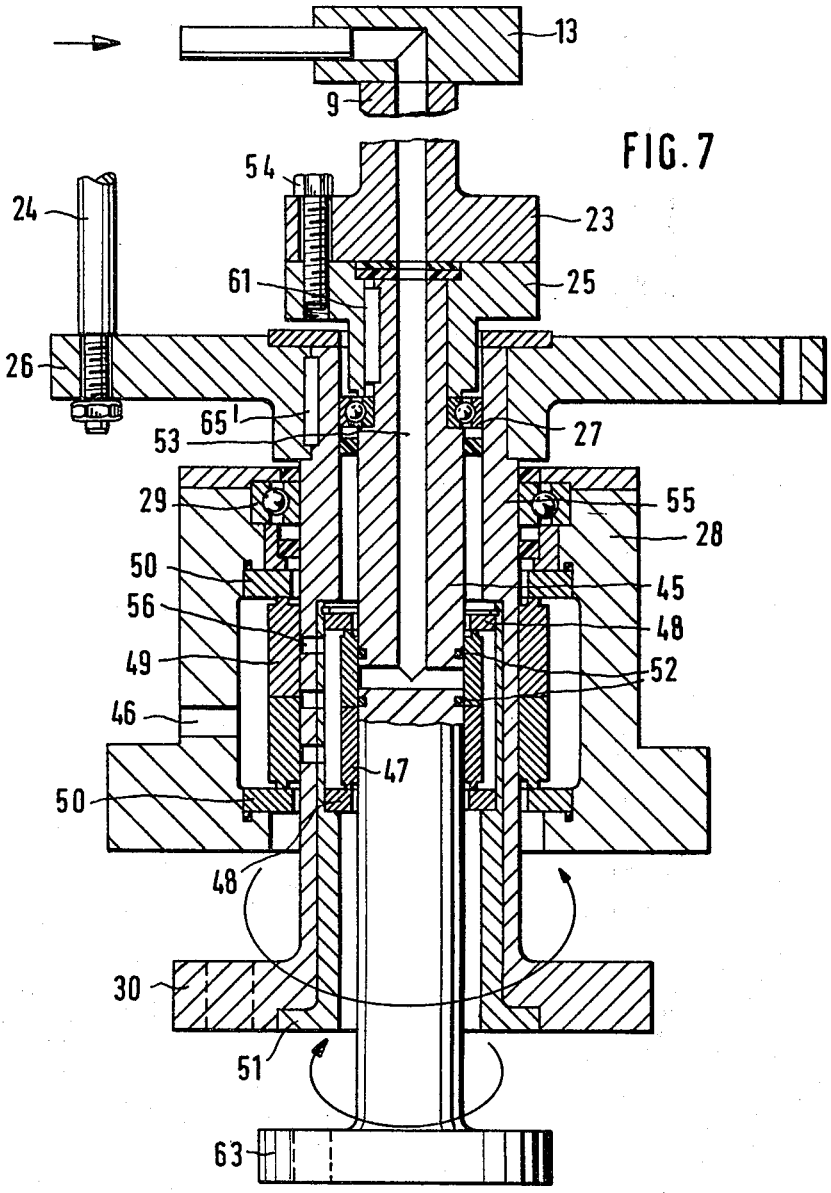
FIG. 7 is an enlarged view of the upper portion of the agitator shown in FIG. 1.

In the illustrated embodiment, note FIGS. 1, 2 and 7, an agitator is disclosed and includes a unitary agitator gear block provided in a gear housing 20 and supported on intermediate housing or agitator cage 21 which, in turn, is supported on the top or upper wall of a vessel 37 within which the material is to be stirred. This upper wall is usually constructed as a cover. A driving motor 1 is flanged to the housing 20 of the gear block and in the illustrated embodiment an electric motor is shown. Vessel 37 is cylindrically shaped and has a conically shaped bottom 43. The bottom, however, may be tapered more or less than illustrated in FIG. 1 or a flat or curved bottom may be used.

As illustrated in FIG. 1, the agitator has a multisection inner and outer agitating shaft. Upper section 9 of the inner agitating shaft and the upper section 10 of the outer agitating shaft in the form of a tubular shaft project downwardly from the gear housing 20. The upper section 9 of the inner agitating shaft forms a shoulder 62 on which a gear 8, which drives the inner agitating shaft, rests. Gear 8, note FIG. 2, is rigidly secured for rotating the upper shaft section 9. The lower end of the upper shaft section 9 forms a flange 23 connected by bolts 54 to a flanged sleeve 25 coupled by means of a spring 61 to the upper end of the intermediate section 35 of the inner agitating shaft, note FIG. 7. The lower end of intermediate section 45 forms a flange 63. Flange 64 of the bottom section 44 of the inner agitating shaft is connected to the flange 63 and the bottom section along with the agitating blades attached to it forms an inner agitating element within the vessel 37.

The outer agitating shaft, in addition to the tubular upper section 10, has a flange sleeve 26 connected to the bottom flange 22 by spacer bolts 24. As shown in FIG. 7, the flange sleeve 26 is secured by a spring 65 to the lower tubular shaft section 55 of the outer agitating shaft. At its lower end, lower section 55 has a flange 30 connected to a crossbeam 32 of the outer agitating element with a ring 31 interposed between them. A section frame 33 of the outer agitating element is secured to and extends downwardly from the crossbeam 32. Section frame 33 is constructed and dimensioned so that it can rotate in closely spaced relationship inwardly from the shell of the vessel 37. Further, section frame 33 supports agitating blades 34 at its lower end. As can be seen in FIG. 1, the agitating blades 34 of the outer agitating element are spaced apart in the vertical direction with the agitating blades 38 of the inner agitating element extending between them. Agitating blades 34, 38 are arranged to rotate in opposite directions. Bottom scrapers 42 are located at the lower end of the section frame 33 and are shaped to conform to the configuration of the inner bottom 43 of the vessel 37. A step bearing 39 is centered within the lower portion of the vessel 37 by means of diagonal supports 41 extending inwardly from the section frame 33. Bearing bushing 40 is inserted in the step bearing 39 and the lower end of the bottom section 44 of the inner agitating shaft is supported in the bearing bushing. Preferably, bearing bushing 40 is formed of a self-lubricating material such as PTFE.

Intermediate housing or cage 21 has one or more lateral inlet openings, for instance, two diametrically opposed openings. Housing 28 for a two-part double-acting side ring seal, described below and shown in FIG. 7, is positioned on the top of vessel 37 in the space laterally enclosed by cage 21. Between the housing 28 and the bottom of the gear housing 20, the flange 22 and flange sleeve 26 in combination with the spacer bolts 24 form a revolving cage which has openings through which the coupling between the upper section 9 and the intermediate section 45, formed by the flange 23 and the flange sleeve 25, can be disconnected. Accordingly, this coupling represents a disconnection point in the inner agitating shaft. Further, the revolving cage in the outer agitating shaft formed by the flange 22, flange sleeve 26 and the spacer bolts 24 affords a disconnection point in the outer agitating shaft by loosening the spacer bolt 24.

A stationary feed head 13 is mounted on the upper end of the upper section 9 of the inner agitating shaft and its function is further explained below in the description of the double-acting sliding seal unit located within the housing 28.

The construction of the gear block located within the housing 20 permits many modifications. Driving source 1 may be, for instance, a polyphase induction motor, or a hydraulic motor with or without variable speed gearing.

In the embodiment displayed in FIGS. 1 and 2, motor 1 drives a bevel gear 3 through a bearing housing 2 which is flanged for attachment and removal. A pinion 5 drives a gear 65 rigidly connected to the upper tubular shaft section 10 so that it rotates the outer agitating shaft in one direction. Upper section 9 of the inner agitating shaft is driven by a pinion 6 by means of an intermediate gear 7 and the gear 8 fixed to the upper section so that the inner agitating shaft is rotated in the opposite direction to the outer agitating shaft. Since gear 8 has a smaller diameter than gear 65, the inner agitating shaft is driven faster than the outer agitating shaft.

The unnumbered shafts of the various spur gear stages located in the gear housing 20 are supported in roller bearings and are lubricated by a circulating lubrication system or by grease packing. The oppositely directed rotational movements of the inner and outer agitating shafts is indicated in FIG. 2 by the arrows 11, 12.

Figure 3:
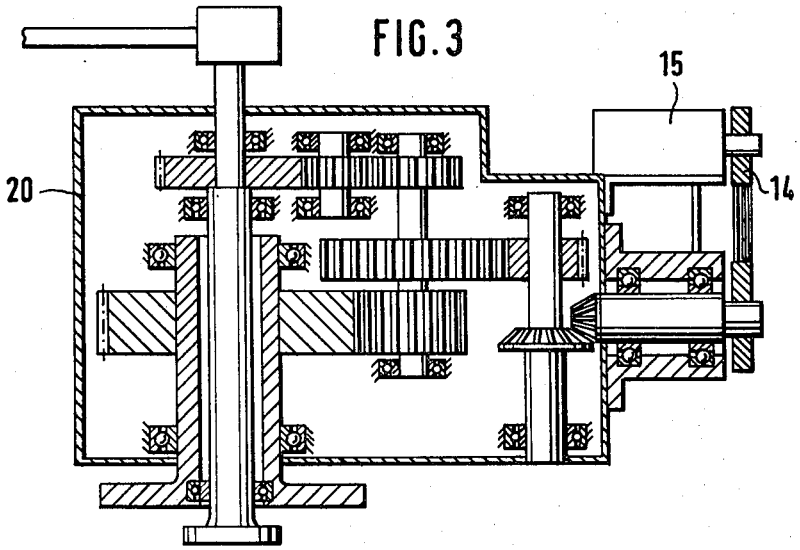
Figure 4:
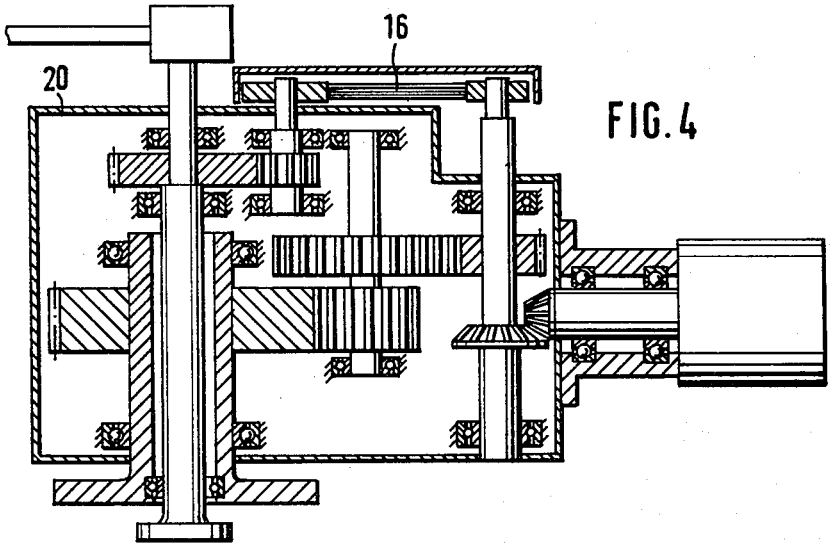

In FIG. 3, the gear block shown in FIGS. 1 and 2, is modified with the motor 1 replaced by a foot-mounted motor 15 having a V-belt assembly 14 which drives the main shaft. In this way, an additional transmission is created. In the embodiment disclosed in FIG. 4, a V-belt drive 16 is provided in the drive train for the inner agitating shaft. By exchanging the gears of the V-belt drive, the rotational speed of the inner agitating shaft and consequently the ratio of the speeds of the inner and outer agitating shafts, can be changed. The V-belt drive 16 can also be replaced by an infinitely variable V-belt drive.

Figure 5:
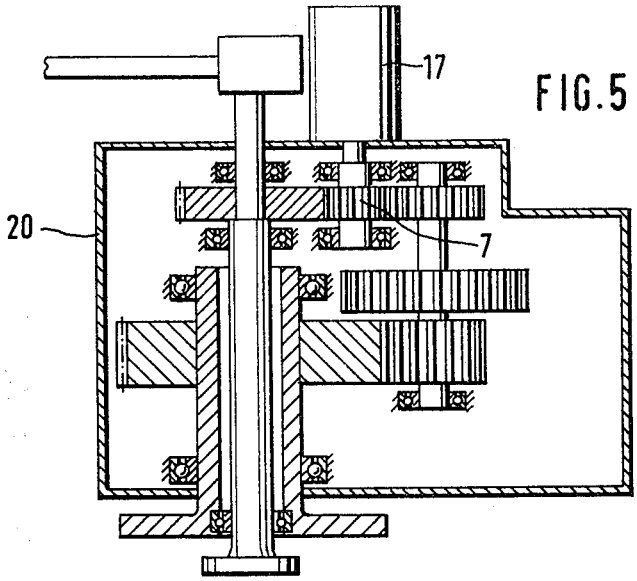

In the embodiment of FIG. 5, the above drive stages are omitted, however, the gear housing 20 is the same. Motor 1 is replaced with a motor drive 17 connected directly to the intermediate gear 7 for driving the tubular shaft 10 via the gear 6, pinion 5 and the gear 65 which is fixed on the tubular shaft 10. In this arrangement, the rotational speed of the drive 17 is reduced to a lesser degree than in the previously described embodiment of the gear block.

Figure 6:
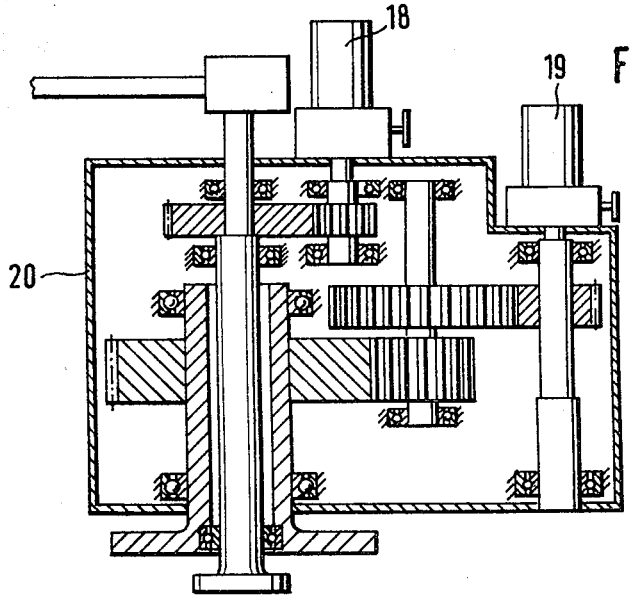

In the embodiment of FIG. 6, the bevel gear drive stage 1, 2, 3 of the embodiment illustrated in FIG. 2 is omitted. Instead, an infinitely variable drive 18 drives the inner agitating shaft and another separate variable speed drive 19 drives the outer tubular shaft 10 which forms the upper end of the outer agitating shaft. In this embodiment the driving speeds and their ratio are infinitely adjustable.

In the housing 28 a slide ring seal housing unit is made up of an inner slide ring seal and an outer slide ring seal, note FIG. 7. The inner seal is formed of a plurality of components with parts 47 subject to wear extending between a pair of stationary slide rings 48. This assembly of components provides a seal between the intermediate section 45 of the inner agitating shaft and the intermediate tubular section 55 of the outer agitating shaft. Similarly, the outer slide ring seal is formed of a plurality of components with parts 49 which are subject to wear extending axially between a pair of stationary slide rings 50 and affording a seal between the lower section of the outer agitating shaft and the stationary housing 28. The parts 47, 49 which are subject to wear, are placed directly on or in the respective shafts.

Upper section 9 and intermediate section 45 of the inner agitating shaft connected by the flange 23 and the flange sleeve 25, contain a central duct 53 extending downward from the feed head 13 to the region of the slide ring seal unit where the duct branches out perpendicularly to the axis of the shaft for supplying sealing, cooling and lubricating media to the parts of the slide ring seal unit which are subject to wear. The medium is introduced into the duct 53 in the feed head 13. The tubular shaft section 55 and assembly sleeve 51 have openings therethrough, such as slots or bores 56, so that the medium conveyed through the duct 53 passes through the openings into the components of the slide ring seal unit subject to wear between the outer agitating shaft and the housing 28. A return duct 46 is positioned in the housing 28 for removing the medium after it flows radially outwardly through the slide ring seal unit.

The tubular shaft section 55 of the outer agitating shaft is guided by a loose bearing 29 and the intermediate section 45 of the inner agitating shaft is guided by another loose bearing 27. Flange sleeve 25 securely holds the bearing 27 on the intermediate section 45 of the inner agitating shaft.

The components 47 subject to wear of the inner slide ring seal are arranged on the intermediate section 45 and rotates with this section to which it is connected by a bolt 48, note FIG. 8. The outer components 49 subject to wear in the outer slide ring seal are adjusted in the same manner on the tubular intermediate section 55 of the outer agitating shaft. In the assembly sleeve 51, the stationary slide rings 48 are firmly connected within the tubular lower section 55. Accordingly, these rings rotate with the outer agitating shaft, while the components 47 subject to wear on the intermediate section 45 rotate with the inner agitating shaft in the opposite direction.

With the media fed in through the feed head 13, into the duct 53, O-rings 52 are arranged to seal the agitating shaft section 45 between the shaft and the components 47 on both sides of the outwardly extending branches of the duct, since the feed pressure of the media is usually maintained approximately 2 bar above the vessel pressure.

As is evident in FIG. 8, the slide rings rotating with the intermediate section 55 of the outer agitating shaft are held in position by a Seeger ring 66 and a flange-mounted ring 36. A slot 35 in sleeve 51 permits the adjustment in the longitudinal direction of the bolt 57 engaged in the groove 58 and also permits adjustment in the axial direction of the intermediate section 45 of the components 47 subject to wear.

The inner components subject to wear are inserted during assembly of the seal unit together with the assembly sleeve 51 into the tubular intermediate section 55 of the outer agitating shaft. Subsequently, sleeve 51 is flanged inside the flange 30 on the lower end of the tubular lower section 55 of the outer agitating shaft.

In FIGS. 9 through 14, the arrows 59 and 60 show the direction of rotation of the agitating blades.

FIG. 9 exhibits the effect on the flow afforded by an angular agitating blade rotating in the direction of the arrow 59.

FIG. 10 discloses the effect of an agitating blade of the same construction, however, rotating in the opposite direction to the agitating blade of FIG. 9. As tests have shown, agitating blades of angular profile result in the least flow resistance at maximum agitating effect, even when the product being stirred is very viscous. Additional turbulence and consequently intensive mixing of the material being stirred results in an undertow at the back side of the agitating blade having an angular shape. While the angular shapes shown in FIGS. 9 and 10 are equilateral the angular shape shown in FIG. 11 has unequal sides.

The agitating blade profile displayed in FIG. 10 and the profile shown in FIG. 12 which has a U-shaped cross-section have proven to be especially suitable for stirring media with a low viscosity. When these blade shapes are used and the rotational movement is in the direction of the arrow 59, mostly axially directed flows are achieved.

In FIGS. 13 and 14, the agitating blades have basically a convex surface in the rotational direction with active turbulence occurring in the turbulent region. Such blade shapes are particularly suitable when the medium to be stirred is laden with solid substances wich must be suspended carefully without being destroyed or broken. The desired effect is achieved by use of the oppositely rotating agitating blade providing shearing forces. In place of the convex surfaces of the agitating blades, concave surfaces can also be used.

The unit or module made up of the slide ring seal unit along with its housing 28, the intermediate section 45 of the inner agitating shaft enclosed in the seal and the lower section 55 of the outer agitating shaft, and the sleeve 51, can be disassembled in the following manner:

Initially, spacer bolts 24 are loosened so that the coupling between the flange 22 and the flange sleeve 26 is broken. Further, the connection between the flange 23 and the flange sleeve 25 is loosened. Subsequently, the entire agitating system including the inner and outer agitating elements can be lifted with means, not shown, through a sufficiently large center opening in the vessel cover so that the flange 30 and ring 31 are displaced outside the surface of the cover. These parts are supported in this lifted position. Next, the connection between the flange 30 and ring 31 and between the flanges 63, 64 are loosened. Subsequently, the module including the slide ring seal unit housing 28 extending in the vertical direction from flange 64 to flange sleeve 25 can be lifted out as a unit. The various figures serve only to explain the construction and not to show in detail the various dimensions.

While specific embodiments of the invention have been shown and described in detail to illustrate the application of the inventive principles, it will be understood that the invention may be embodied otherwise without departing from such principles.

I claim:

1. An agitator for stirring flowable material, said agitator being arranged to be tightly positionable on a vessel, such as a pressure vessel, and comprising a first agitating element and a second agitating element each driven in an opposite rotational direction about a common axis, said first agitating element includes an inner agitating shaft, said second agitating element extends around said first agitating element and includes a tubular outer agitating shaft laterally enclosing said inner agitating shaft, each of said first and second agitating elements supporting agitating blades for producing different flow characteristics in the material to be stirred depending on the application of the material, a housing enclosing said inner and outer agitating shafts and within said housing said inner agitating shaft is sealed relative to said outer agitating shaft and said outer agitating shaft is sealed relative to said housing, wherein the improvement comprises that a slide ring seal unit provides the seal between said inner and outer agitating shafts and between said outer agitating shaft and said housing and comprises two axially coextensive plural component slide ring seals one located within the other and both enclosed by said housing with one of said plural component slide ring seals located between said inner agitating shaft and said outer agitating shaft and the other one of said plural component slide ring seal positioned between said outer agitating shaft and said housing.

2. An agitator, as set forth in claim 1, wherein said plural component slide ring seals each include components subject to wear placed in direct contact on said inner and outer agitating shafts without utilizing interconnecting protective sleeves.

3. An agitator, as set forth in claim 1 or 2, wherein said inner agitating shaft extends vertically upwardly from said housing laterally enclosing said plural component slide ring seals, a central duct extending downwardly through said inner agitating shaft from the upper end thereof into the region of said slide ring seals for supplying sealing, cooling and lubricating medium to said components of said slide ring seals which are subject to wear, a stationary feed head connected to the upper end of said inner agitating shaft for supplying the medium into said duct and said duct having branches at the lower end thereof extending outwardly for supplying the medium to said slide ring seal between said inner and outer agitating shafts, and said outer agitating shaft having openings therethrough for conveying the medium to said slide ring seal between said outer agitating shaft and said housing, and a return duct for the medium located in said housing.

4. An agitator, as set forth in claim 1 or 2, wherein a vessel for the material to be stirred is located below said housing enclosing said plural component slide seal rings and said housing being supported on the upper end of said vessel, means forming an openable coupling location for said inner agitating shaft and said outer agitating shaft with said means located above said housing, an intermediate housing supported on said vessel and extending upwardly therefrom laterally enclosing said housing around said plural component slide ring seals and said means forming the openable coupling for said inner and outer agitating shafts, a gear block located within a housing mounted on the upper end of said intermediate housing so that said gear block and housing forms a closed unit and includes separate output shafts for said inner and outer agitating shafts.

5. An agitator, as set forth in claim 4, wherein said outer agitating shaft and said inner agitating shaft each comprises an upper section located above and extending downwardly into said intermediate housing, and a second section extending from the lower end of said upper section downwardly through said intermediate housing, said coupling for said outer agitating shaft includes a flange at the lower end of said upper section of said outer agitating shaft, a flange sleeve at the upper end of said second section of said outer agitating shaft, said flange and said flange sleeve being disposed in spaced relation in the axial direction of said outer agitating shaft and spacer bolts extending between and connecting said flange and said flange sleeve together, said coupling for said inner agitating shaft comprises a flange on the lower end of the upper section of said inner agitating shaft, a flange sleeve on the upper end of said second section of said inner agitating shaft with said flange and flange sleeve disposed in contacting engagement and located within the axial range between said flange and flange sleeve of said outer agitating shaft.

6. An agitator, as set forth in claim 5, wherein a spring connects said flange sleeve of said inner agitating shaft to said second section of said inner agitating shaft.

7. An agitator, as set forth in claim 5, wherein a spring connects said flange sleeve of said outer agitating shaft to the upper end of said second section of said outer agitating shaft.

8. An agitator, as set forth in claim 5, wherein said slide ring seal unit along with said housing which encloses said unit, said intermediate section of said inner agitating shaft enclosed by the inner one of said slide ring seals, and said intermediate section of said outer agitating shaft which laterally encloses said inner slide ring seal, from an assembly which can be disassembled as a unit.

9. An agitator, as set forth in claim 1, wherein said inner and outer agitating shafts extend vertically upwardly, gearing for driving the oppositely rotating said inner and outer agitating shafts mounted on the upper ends of said shafts, a housing enclosing said gearing, said gearing including a first output shaft for said inner agitating shaft and a second output shaft for said outer agitating shaft and driving means for said gearing, and said gearing and housing being arranged so that different said driving means can be used.

10. An agitator, as set forth in claim 1, wherein said inner and outer agitating shafts extend upwardly, an inner agitating element secured to the lower end of said inner agitating shaft and an outer agitating element secured to the lower end of said outer agitating shaft, each of said inner and outer agitating elements extending in the axial direction of said agitating shafts, and agitating blades secured to axially spaced locations of said inner and outer agitating elements.

11. An agitator, as set forth in claim 10, wherein said blades on said inner and outer agitating elements each having a free end and adjacent said free ends said blades having an angular shape with equal length legs and the intersection of said legs leading in the direction of the rotation of said blades.

12. An agitator, as set forth in claim 10, wherein said blades have an angular shape with unequal legs and the intersection of said legs leading in the direction of rotation of said blades.

13. An agitator, as set forth in claim 10, wherein said agitating blades are U-shaped and have a bight section and legs extending outwardly from the opposite edges of said bight section, said bight section and said legs being inclined with respect to the direction of rotation of said blades with said bight section leading said legs in the direction of rotation of said blades.

14. An agitator, as set forth in claim 10, wherein said agitating blades have a curved portion adjacent the free ends thereof and said curved portion having a convex surface and a concave surface and with the convex surface facing in the direction of rotation of said blades.

15. An agitator, as set forth in claim 10, wherein said agitating blades have a curved portion adjacent the free ends thereof and said curved portion having a convex surface and a concave surface with said concave surface facing in the direction of rotation of said blades.

16. An agitator, as set forth in claim 10, wherein said agitating blades are removably mounted on said inner and outer agitating elements so that blades of different shapes can be attached to said agitating elements.

* * * * *